United States Patent [19]

Gentile

[11] 4,051,974

[45] Oct. 4, 1977

[54] SEALING APPARATUS

[75] Inventor: Charles J. Gentile, North Caldwell, N.J.

[73] Assignee: Orange Products, Inc., Chatham, N.J.

[21] Appl. No.: 658,862

[22] Filed: Feb. 18, 1976

[51] Int. Cl.[2] ..... B65D 41/04

[52] U.S. Cl. ..... 215/329; 220/306

[58] Field of Search ..... 215/329, 318, 339, 295; 401/213, 190, 244; 220/306, 85 P

[56] References Cited

U.S. PATENT DOCUMENTS

| | | | |
|---|---|---|---|
| 856,280 | 6/1907 | Morse | 220/306 |
| 3,136,458 | 6/1964 | Ruetz | 220/306 |
| 3,252,446 | 4/1966 | Bateman | 220/352 |
| 3,430,798 | 3/1969 | Goyet | 215/295 |
| 3,904,063 | 9/1975 | Hauser | 215/318 |
| 3,955,696 | 5/1976 | Finke | 215/318 |

*Primary Examiner*—R. E. Hart

*Attorney, Agent, or Firm*—Carella, Bain, Gilfillan & Rhodes

[57] ABSTRACT

An improved sealing apparatus for applicators of the type having means for sealing an exposed surface of an applicator from the environment comprises means for positively locking the sealing means, means for unlocking the sealing means and means for disengaging the sealing means.

4 Claims, 7 Drawing Figures

SEALING APPARATUS

BACKGROUND OF THE INVENTION

This invention relates generally to the field of sealing containers, and more specifically to improved sealing apparatus for applicators of viscous, liquid, or other substances.

The importance of sealing applicators of liquid or viscous substances from the environment, particularly the atmosphere, between uses lies in the danger that liquid or viscous residue on the applicator will harden and impair the operation of the structure. For example, in roller applicators—such as those used for roll-on deodorants—the residue liquid around the roller or ball tends to dry and cake, thereby fouling the ball and tending to inhibit subsequent rotation. Conventional means for sealing the exposed surface of the ball from the environment generally take the form of caps which screw onto the container holding the ball and the liquid. Some of the caps are designed to push the ball down into its fitment, others are designed to pinch the fitment from its sides, and all are designed to provide some degree of insulation between the ball and the environment. Similar conventional means are utilized in sealing other types of applicators, for example sponge applicators.

In every case, the degree of insulation between the exposed surface of the applicator and the environment is directly related to the degree of tightness achieved between the sealing cap and the applicator. However, from the practical or commercial viewpoint the degree of tightness in the conventional methods mentioned above is limited by the degree of facility of the removal of the cap necessary to prevent unacceptable customer annoyance. It will be recognized by those skilled in the art that the solution to the insulation problem of applicators of liquid or viscous material must lie in the reconciliation of the two seemingly antithetic objectives of tightness and facility of removal.

SUMMARY OF THE INVENTION

It is an object of the present invention, therefore, to provide a sealing apparatus for applicators of liquid or viscous materials wherein the degree of insulation between the sealing cap and the applicator is improved, while simultaneously maintaining facility of removal of the cap. As used in the claims, the term "sealing apparatus" will be taken to refer to the cap itself and structural elements on the applicator and the cap.

This object and others not enumerated are achieved by the present invention, one embodiment of which may include a cap which positively locks upon the applicator by means of tabs on the cap and a circumferential flange on the applicator, cam surfaces beneath the flange upon which the tabs may traverse to achieve unlocking of the cap from the applicator, and additional cam surfaces on the applicator upon which indentations in the cap may traverse to achieve disengagement of the cap from the applicator.

BRIEF DESCRIPTION OF THE DRAWINGS

A more complete understanding of the invention may be had from the following detailed description thereof, particularly when read in the light of the accompanying drawings, wherein.

DETAILED DESCRIPTION

Figure 1:
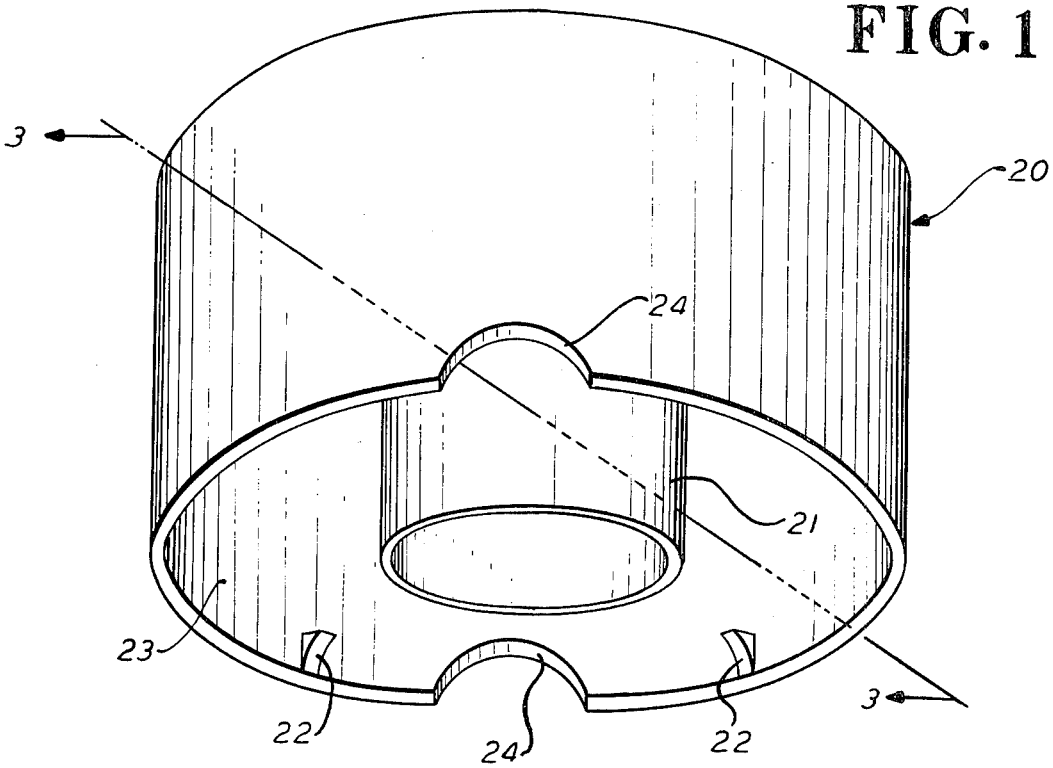
FIG. 1 is a perspective view of a side and the underside of a cap according to the present invention.
Figure 2:
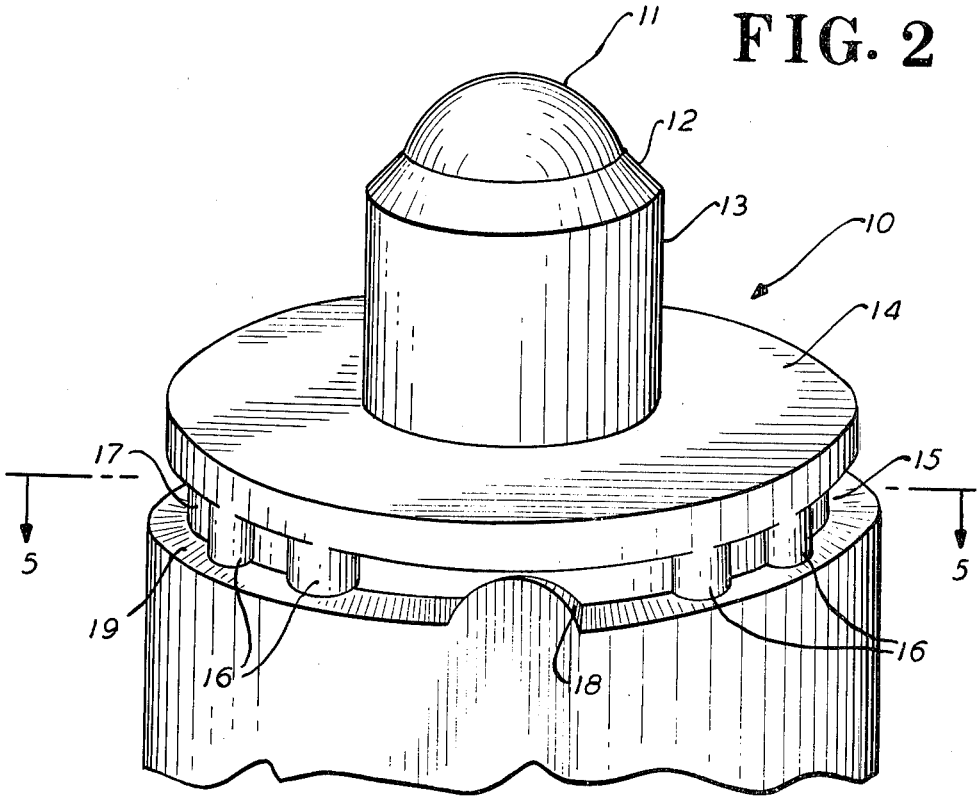
FIG. 2 is a partial perspective view of a roller applicator with its fitment according to the present invention.

Referring generally to FIGS. 1 and 2, a sealing apparatus comprises a roller applicator assembly 10 with a roller or ball 11 housed in a fitment 12 with a cylindrical neck 13, and a cap assembly 20 with a depending apron 21 and a cylindrical wall 23. These structures are common in presently market roller applicators.

Referring now specifically to FIG. 2, structure of the embodied invention includes a continuous circumferential flange 14 surmounting a generally rectangular groove 15 which circumscribes the applicator assembly 10. Eight cam surfaces 16 (only four are shown in FIG. 2) project from the interior wall 17 of the groove 15.

Two additional cam surfaces 18 (only one is shown in FIG. 2) project upwardly from the bottom wall 19 of groove 15.

A cap 20 is shown in FIG. 1. Structure of the embodied invention includes four tabs 22 (only two are designated in FIG. 1), which project inwardly from the interior side of wall 23 of cap 20. The tabs 22 are spaced with respect to each other such that they can be aligned between pairs of horizontal cam surfaces 16 on container 14 when the cap 20 is fit over the container 14.

The tabs 22 have top surfaces generally perpendicular to wall 23 and generally parallel to the top of cap 20. The tabs also have inclined surfaces generally extending from the bottom of wall 23 to the top surfaces. The interior circumference of wall 23 is slightly larger than the circumference of flange 14, so that tabs 22 will flare outward when cap 20 is forced onto applicator assembly 10.

Two arcuate indented surfaces 24 project upwardly from the bottom edge of cap 20. The indented surfaces 24 have a depth slightly larger than the height of the vertical cam surfaces 18 on container 14. The bottom arc width of the idented surfaces 24 is in excess of the arc width of the base of the vertical cam surfaces 18. The indented surfaces are spaced with respect to each other and with respect to the tabs 22 so that the indented surfaces 24 will be centered over the vertical cam surfaces 18 when the cap 20 is fitted over the flange 14 and so that the tabs 22 are between the horizontal cam surfaces 16.

Figure 3:
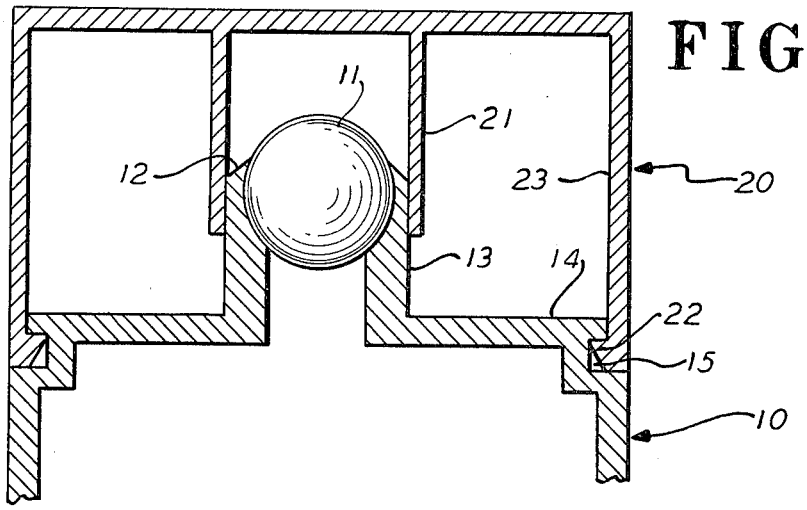
FIG. 3 is a cross-sectional view of the cap and applicator in sealed position taken through the plane 3—3 of FIG. 1 of the cap, according to the present invention.
Figure 4:
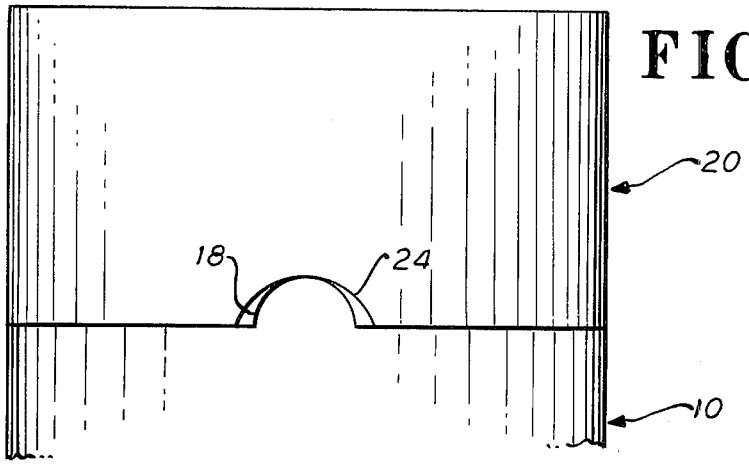
FIG. 4 is a partial side elevational view of the cap and the applicator in sealed position according to the present invention.

The total apparatus operates in the following manner. Cap 20 is forced down upon fixture 10 such that apron 21 engages the cylindrical neck 13 of fitment 12, and so that tabs 22 flare outward over flange 14 and snap into groove 15. The cap assembly is now in sealed position and is illustrated in FIG. 3.

In this sealed position, the exposed surface of the roller applicator 11 is tightly sealed from the environment by the apron 21. The outer diameter of cylindrical neck 13 of fitment 12 is approximately equal to the inner diameter of apron 21, so that an interference fit is present. Furthermore, the cap assembly 20 is positively locked in this sealed position by the abutment of the top surfaces of tabs 22 with the bottom surface of flange 14.

Figure 5:
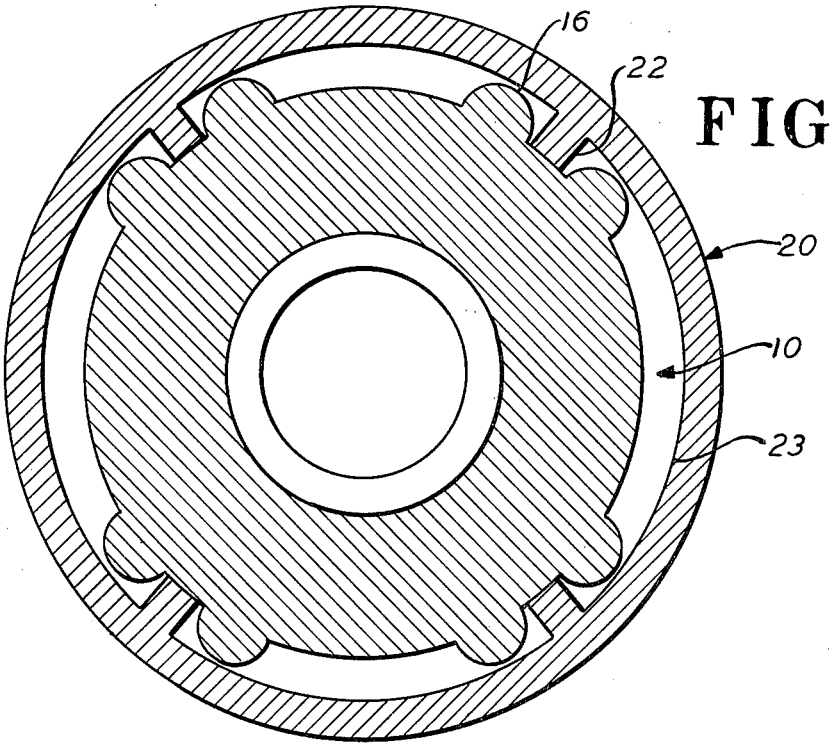
FIG. 5 is a cross-sectional view of the cap and applicator in sealed position taken through the plane 5—5 of FIG. 2, according to the present invention.

The cap assembly is unlocked by rotation of the cap 20 with respect to applicator assembly 10. FIG. 5 illustrates the relative position of the cap 20 and applicator assembly 10 in sealed position prior to rotation. As cap 20 is rotated in either direction, tabs 22 ride upon cam surfaces 16 and flare outward, so that their upper surfaces no longer abut the bottom surfaces of flange 14.

The fit between apron 21 and cylindrical neck 13 of fitment 12 is designed to be so tight that the cap 20 cannot be disengaged from applicator assembly 10 by mere pulling. Disengagement is achieved in the following manner. Cap 20 is further rotated so that the indented surfaces 24 ride upon cam surfaces 18, thereby forcing cap 20 away from applicator assembly 10 and disengaging the two. Since the cam surface acts in principle like a curvilinear inclined plane giving a mechanical advantage, and since the human hand can exert greater rotational force than pulling force, the disengaging means described above can overcome a degree of tightness between apron 21 and fitment 12 that mere pulling could not.

Figure 6:
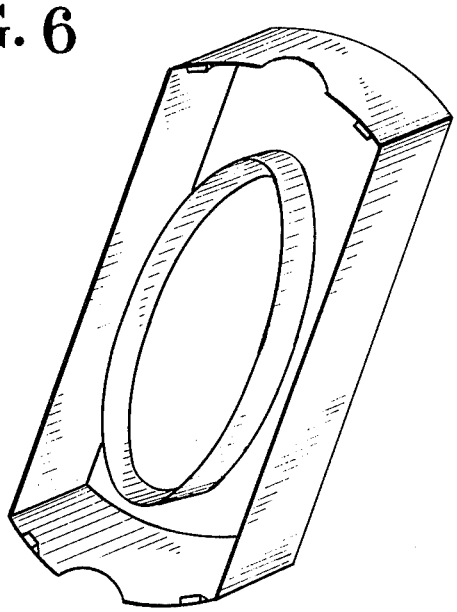
FIG. 6 is a perspective view of the underside of a cap according to the present invention.

A variation of this embodiment of the invention can be practiced upon those roller applicators where the applicator element takes the general shape of a prolate ellipsoid. In this case, the applicator assembly generally takes the form of a bulging rectangular solid. The tabs and horizontal cam surfaces which effect the locking and unlocking of the cap are best located in the corners of the cap, and the vertical cam surfaces and corresponding indented surfaces in the cap are best located on the shorter sides of the cap and applicator assembly. The locations of the tabs and the indented surfaces are illustrated in FIG. 6. It has been found that the device yields optimal performance when the dimensions and proximity of the tabs and cam surfaces are selected so as to effect unlocking at a rotation of approximately 2°, and disengagement at a total rotation of less than 45°.

Figure 7:
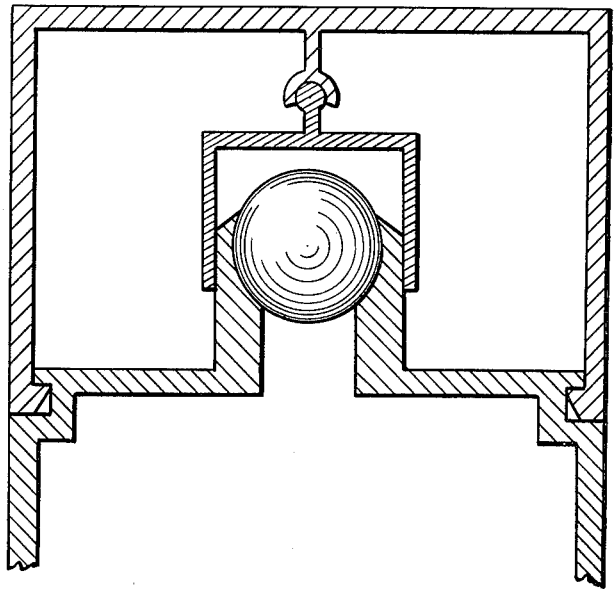
FIG. 7 is a partial cross-sectional view of a cap and applicator according to the present invention taken through a plane corresponding to the plane 3—3 of FIG. 1.

The present invention may be practiced with a variety of sealing means other than a rigid depending cylindrical apron. For example, a depending apron which is movable on a ball joint arrangement, as depicted in FIG. 7, could be employed with the present invention. Furthermore, the present invention may be practiced in connection with a variety of applicators other than the roller applicator, for example spongehead applicators.

Although only three embodiments of the invention have been disclosed, it will be recognized that other structures are possible which would fall within the scope of the teachings, and are therefore submitted to be within the spirit and the scope of the present invention.

What is claimed is:

1. An improved sealing apparatus for an applicator of the type having a means for sealing an exposed surface of an applicator from the environment, said sealing means comprising or included within a cap, wherein the improvement comprises:

a. means for positively locking said sealing means to said applicator;

b. means for unlocking said sealing means from said applicator; and c. means for disengaging said sealing means from said applicator comprising a plurality of arcuate surfaces concavely set in an interior wall of said cap and a plurality of cam surfaces extending upwardly from said applicator, such that said arcuate surfaces are in registration with said cam surfaces when said cap and applicator are in sealed position.

2. An improved sealing apparatus as recited in claim 1 wherein said means for positively locking said sealing means to said applicator comprises:

a. a continuous flange encircling said applicator and facing away from the exposed surface of said applicator; and b. a plurality of tabs protruding generally perpendicular from an interior surface of said cap, such that when said cap is engaged to said applicator the upper surfaces of said tabs positively interlock with said continuous flange.

3. An improved sealing apparatus as recited in claim 2 wherein said means for unlocking said sealing means comprises a plurality of cam surfaces projecting outwardly from said applicator, said cam surfaces located so as to be contiguous to said tabs when said cap and applicator are in sealed position and of dimension sufficient to force said tabs radially outward beyond said flange when said cap is rotated such that said tabs ride upon said cams.

4. In sealing apparatus including an applicator assembly provided at the top thereof with an upwardly extending fitment for housing means for applying a substance, and further including a cap provided with a top, a downwardly extending exterior side wall having a bottom edge and a downwardly extending interior apron for being forced downwardly a predetermined distance over and around said fitment and into forced interference engagement therewith whereby said apron and said cap seal said means for applying said substance from the environment, said cap side wall having an inner diameter, wherein the improvement comprises:

a continuous circumferential flange provided on said applicator assembly below said fitment, said flange being slightly smaller in diameter than said inner diameter of said cap side wall;

said applicator assembly having a groove formed therein circumscribing said applicator assembly below said flange, said groove being defined by a top, bottom and interior side wall;

a plurality of pairs of first cams provided in said groove and being disposed at predetermined circumferential positions therein, said pairs of first cams being of arcuate configuration and projecting radially outwardly a predetermined distance from said interior wall of said groove;

a plurality of second cams provided in said groove and being disposed at predetermined circumferential positions therein with each of said second cams being disposed intermediate two pairs of said first cams, said second cams being of arcuate configuration and projecting radially upwardly from said bottom wall of said groove and having a predetermined height and base width;

a plurality of tabs equal in number to said pairs of said first cams and projecting radially inwardly a predetermined distance from the interior of said cap side wall, said tabs being disposed at predetermined circumferential positions around said cap interior side wall and said tabs having top surfaces generally perpendicular to said cap side wall and generally parallel to the top of said cap and said tabs also provided with inclined surfaces extending generally upwardly from the interior of said cap side wall to the top of said tab surfaces;

said bottom edge of said cap side wall having a plurality of arcuate indented surfaces formed therein equal in number to said second cams and extending upwardly a predetermined distance from said bottom edge of said cap side wall, said arcuate indented surfaces having a depth slightly larger than said height of said second cams and said indented arcuate surfaces having a bottom arc width slightly in excess of said width of said base of said second cams;

upon said cap being axially aligned with and placed on said applicator assembly to cause said sealing engagement between said apron and said fitment, said flange engaging said tabs to cause said cap side wall to flare radially outwardly over said flange and said top surfaces of said tabs engaging the underside of said flange thereby positively locking said cap to said applicator assembly, and each of said tabs residing between a pair of said first cams and each of said indented arcuate surfaces residing over one of said second cams; and upon said cap being rotated with respect to said applicator assembly a predetermined angular distance, said tabs engaging one of said first cams of said pairs thereof to cause said cap side wall to be flared radially outwardly such that said tabs extend radially outwardly beyond said flange whereby said cap is unlocked from said applicator assembly and whereby said indented arcuate surfaces engage said second cams to cause said cap to be forced axially upwardly with respect to said applicator assembly a predetermined distance sufficient to disengage said apron from said fitment.

* * * * *